US005282004A

United States Patent [19]

Matsuno et al.

[11] Patent Number: 5,282,004

[45] Date of Patent: Jan. 25, 1994

[54] ELECTROPHOTOGRAHIC APPARATUS AND METHOD FOR PREVENTING ATTRACTION OF COPY SHEET TO PHOTORECEPTOR

[75] Inventors: Junichi Matsuno, Toride; Masaru Nakano, Tsukuba, both of Japan

[73] Assignee: Hitachi, Ltd. and Hitachi Koki Co., Ltd., Tokyo, Japan

[21] Appl. No.: 32,281

[22] Filed: Mar. 17, 1993

Related U.S. Application Data

[63] Continuation of Ser. No. 813,656, Dec. 27, 1991, abandoned.

[30] Foreign Application Priority Data

Dec. 28, 1990 [JP] Japan ..... 2-408864

[51] Int. Cl.[5] ..... G03G 15/14

[52] U.S. Cl. ..... 355/271; 355/309; 355/315

[58] Field of Search ..... 355/271, 273, 274, 277, 355/308, 309, 315; 271/188; 162/270, 271

[56] References Cited

U.S. PATENT DOCUMENTS

| | | | |
|---|---|---|---|
| 3,687,539 | 8/1972 | Furuichi | 355/233 |
| 4,408,861 | 10/1983 | Hukuda et al. | 355/315 |
| 4,411,511 | 10/1983 | Ariyama et al. | 355/315 |
| 4,627,718 | 12/1986 | Wyer | 162/271 X |

FOREIGN PATENT DOCUMENTS

| | | | |
|---|---|---|---|
| 0046274 | 4/1981 | Japan | 355/309 |
| 0643366 | 6/1981 | Japan . | |
| 0111550 | 7/1982 | Japan | 355/271 |
| 0011963 | 1/1983 | Japan | 355/309 |
| 0126366 | 7/1984 | Japan | 355/274 |
| 0052880 | 3/1985 | Japan | 355/271 |
| 0095668 | 4/1990 | Japan . | |

OTHER PUBLICATIONS

Goel, Xerox Disclosure Journal, vol. 2, No. 1, Jan.-/Feb. 1977.

*Primary Examiner*—A. T. Grimley
*Assistant Examiner*—Robert Beatty
*Attorney, Agent, or Firm*—Antonelli, Terry Stout & Kraus

[57] ABSTRACT

The present invention provides an electrophotographic copying apparatus in which a copy sheet is attracted to and delivered by a transfer belt to perform a transfer operation, wherein a sag of the leading end of the copy sheet is removed to prevent the copy sheet from being attracted to a photoreceptor, venting method of preventing attraction of the copy sheet. Stacked copy sheets are individually separately supplied, with each of the copy sheets being electrostatically attracted to and delivered by the transfer belt. The copy sheet is held between the photoreceptor and the transfer belt and is in contact with them. The photoreceptor carries an electrostatic latent image corresponding to an image information and a toner electrostatically attracted to the electrostatic latent image. The toner image on the photoreceptor is transferred to the copy sheet. The leading end of the copy sheet delivered to a transfer section defined by the photoreceptor, the transfer belt and a transfer corrotron is slightly bent toward the photoreceptor.

10 Claims, 9 Drawing Sheets

ELECTROPHOTOGRAHIC APPARATUS AND METHOD FOR PREVENTING ATTRACTION OF COPY SHEET TO PHOTORECEPTOR

This is a continuation of application Ser. No. 813,656, filed Dec. 27, 1991, now abandoned.

BACKGROUND OF THE INVENTION

The present invention relates to an electrophotographic apparatus and, more particularly, to a method of preventing a copy sheet from being attracted to a photoreceptor thereof, and an electrophotographic apparatus for carrying out this method.

A conventional electrophotographic apparatus is disclosed in, for example, Japanese Patent Unexamined Publication No. 2-95668, wherein a combination of an elastic roller and a metallic roller is provided, with the elastic roller being pressed against the metallic roller by applying a load to the elastic roller, and with a copy sheet being passed between these two rollers and curled in a direction away from a photoreceptor, in order to prevent the copy sheet from being attracted to the photoreceptor.

However in above mentioned conventional copying apparatus consideration is given to the attraction of copy sheets to a photoreceptor due to sags formed in the leading ends of the copy sheets when they are cut, and attraction of thin copy sheets to a photoreceptor, which copy sheets have low rigidity to flexural deformation.

That is to say, the conventional apparatus has a problem of a frequent attraction of copy sheets to the photoreceptor in correlation with the number of copy sheets cut in one cutting operation. It has also a problem that a curl of a copy sheet after printing, which is caused as a result of attraction to the photoreceptor, deteriorates the printing quality.

SUMMARY OF THE INVENTION

In accordance with the present invention, it has been determined that attraction of a copy sheet to a photoreceptor is mainly induced by a sag of the leading end of the copy sheet, which sag has substantially the same magnitude as the thickness of the copy sheet and is oriented in a direction away from the photoreceptor. More specifically, when the leading end of the copy sheet has a sag extending in a direction away from the photoreceptor, i.e., in a direction from the photoreceptor to a transfer belt, an air gap is produced between the copy sheet and the transfer belt. This gap deteriorates the function of the transfer belt of electrostatically attracting the copy sheet, and consequently, the copy sheet is attracted to the photoreceptor with which the copy sheet is contacted at a transfer section.

It is therefore an object of the invention to solve the above-described problems and to provide an electrophotographic copying apparatus especially of a type in which a copy sheet is attracted to and delivered by a transfer belt to perform a transfer operation, wherein a sag of the leading end of the copy sheet is removed to prevent the copy sheet from being attracted to the photoreceptor, and a method of preventing such attraction.

In order to achieve the above-described object, the invention provides an electrophotographic apparatus comprising sheet supply means for separately individually supplying stacked copy sheets, an endless transfer belt made of a dielectric material for electrostatically attracting and delivering each of the copy sheets and pulleys for driving the transfer belt. The transfer belt was around at least one pulley with a photoreceptor being provided for carrying an electrostatic latent image corresponding to an image information and a toner electrostatically attracted to the electrostatic latent image. A transfer section is provided at which each of the copy sheets is held between the photoreceptor and the transfer belt in contacted with them so as to transfer the toner image on the photoreceptor to the copy sheet delivered by the transfer belt. Means for bending the leading end of each of the copy sheets slightly toward the photoreceptor are provided between the sheet supply means and the transfer section.

According to one aspect of the invention, there is provided an electrophotographic apparatus wherein means for bending the leading ends of the copy sheets are provided between the sheet supply means and the transfer portion, with the sheet bending means comprising a support section for supporting the leading end of each of the copy sheets, a stationary section having a rounded edge to be contacted with the leading end of the copy sheet, and a movable section adapted to be moved with a predetermined gap from the stationary section so that the leading end of the copy sheet, located in the gap between the stationary section, and the movable section is bent slightly toward the photoreceptor.

According to another aspect of the invention, there is provided a method of preventing a copy sheet from being attracted to a photoreceptor in an electrophotographic apparatus, wherein stacked copy sheets are separately individually supplied with each of the copy sheets electrostatically attracted to and delivered by an endless transfer belt made of a dielectric material until the copy sheet reaches a transfer section where the copy sheet is held between the photoreceptor and the transfer belt in contact with them. The photoreceptor carries an electrostatic latent image corresponding to an image information and a toner is electrostatically attracted to the electrostatic latent image. The toner image on the photoreceptor is transferred to the copy sheet delivered by the transfer belt. According to the method of the present invention, the leading end of each of the copy sheets being delivered to the transfer portion is slightly bent forward toward the photoreceptor.

With the above-described structure of the invention, since the leading end of each copy sheet being delivered to the transfer section can be slightly bent toward the photoreceptor, no air gap is produced between the copy sheet and the transfer belt when the copy sheet is held between the photoreceptor and the transfer belt. Therefore, the electrostatic attraction function of the transfer belt takes such a great effect that no copy sheet will be attracted to the photoreceptor.

DESCRIPTION OF THE PREFERRED EMBODIMENTS

Figure 1:
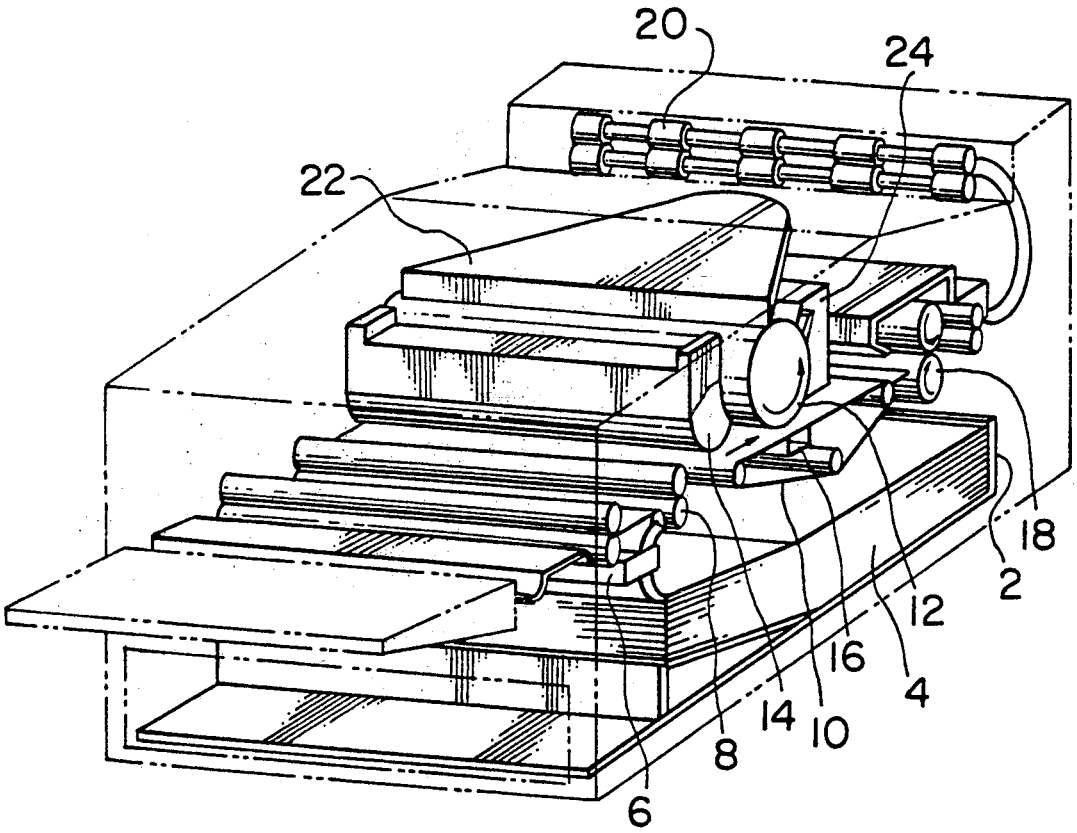
FIG. 1 is a schematic perspective view of an electrophotographic apparatus according to one embodiment of the present invention.

As shown in FIG. 1, copy sheets 4 stacked in a hopper 2 are separately individually delivered and fed into means 6 for bending the leading ends of the copy sheets. Sheet supply rollers 8 deliver each copy sheet 4 to a transfer belt 10, and the transfer belt 10 carries the copy sheet 4 to a transfer section where a toner image on a photoreceptor drum 12 is tranferred to the copy sheet 4. A toner image on the photoreceptor drum 12 is made visible by developer means 14. A transfer corrotron 16 is provided opposite to the photoreceptor drum 12 and on the back side of the transfer belt 10, and the transfer corrotron 16 causes the toner image on the photoreceptor drum 12 to be electrostatically attracted to the copy sheet 4. Then, the copy sheet 4 is delivered to fixing means 18 where the toner image is fixed on the copy sheet 4. After the fixing operation, the copy sheet 4 is discharged to an output tray by discharge rollers 20. An optical unit 22 produces images on the photoreceptor drum 12, and a cleaner 24 for cleans remaining toner on the photoreceptor drum 12, and so forth.

Figure 2:
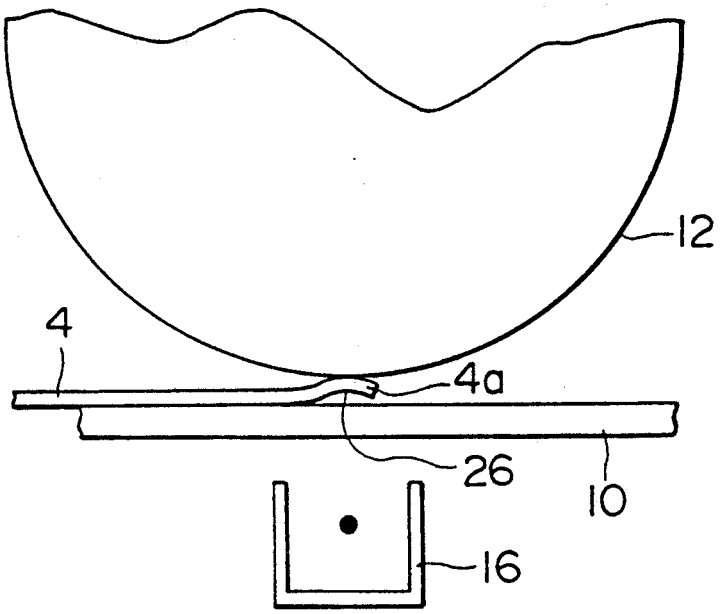
FIG. 2 (PRIOR ART)
FIG. 2 is a view showing a phenomenon that a copy sheet is attracted to a photoreceptor in a conventional apparatus.
Figure 3:
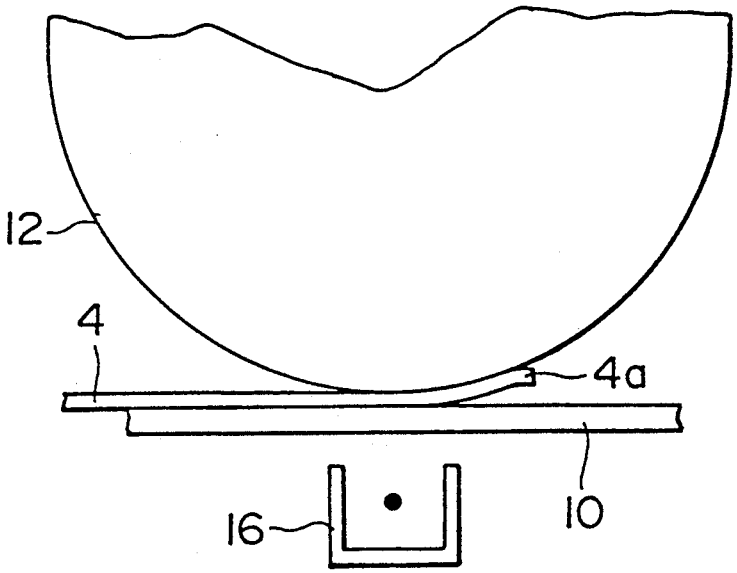
FIG. 3 (PRIOR ART)
FIG. 3 is another view showing a phenomenon that the copy sheet is attracted to the photoreceptor in the conventional apparatus.

Referring now to FIGS. 2 and 3, there will be described the circumstances under which the leading end of each copy sheet 4 is passed through the transfer section in a conventional electrophotographic apparatus.

Copy sheets are cut from a roll of paper by a cutting machine. Consequently, depending on the blade sharpness of the cutting machine and the number of sheets cut in one cutting operation, deformed portions or sags of various dimensions remain in resulting copy sheets, as produced in the leading end 4*a* of the copy sheet 4 shown in FIG. 2. Due to an influence of such a sag, an air gap 26 is produced between the transfer belt 10 and the copy sheet 4. In this gap, electric discharge is caused, and static electricity is removed. As a result, the leading end 4*a* of the copy sheet 4 is attracted to the photoreceptor drum 12, and accordingly, the copy sheet 4 is attracted to the photoreceptor drum 12, as shown in FIG. 3. The magnitude of a large sag is about 1.5 times as large as the thickness of a copy sheet. Sags are produced in one direction, and the magnitude of a sag varies in a cycle corresponding to the number of copy sheets cut in one operation. More specifically, providing that a plurality of copy sheets, for instance, five copy sheets are cut at a time, a sag produced in the leading end of the bottom copy sheet is the smallest, and a sag produced in the leading end of the top copy sheet is the largest. Therefore, the magnitudes of sags vary cyclically every five copy sheets.

In order to eliminate the influence of such a sag at the transfer section and to prevent the copy sheet 4 from being attracted to the photoreceptor drum 12, the sag on the leading end of the copy sheet 4 should be corrected by bending it in a direction opposite to the sag, i.e., in a direction toward the photoreceptor drum 12. However, if it is bent excessively, problems arise in that a copy sheet jam in a sheet delivery passage may occur at the downstream side of the sheet bending means 6.

The sheet bending means 6 will now be described with reference to FIGS. 4 to 7. For better understanding, each of the drawings is arranged so that the copy sheet is supplied from the left side in substantially the same manner as FIGS. 1 to 3. Consequently, the leading end of the copy sheet is bent downwardly. In practice, however, the sheet bending means 6 are placed upside down, or the photoreceptor drum 12 is disposed on the lower side of the sheet bending means 6, so that the leading end of the copy sheet will be bent in the direction toward the photoreceptor drum 12. In other words, in FIGS. 4 to 7, the photoreceptor drum 12 is located on the lower side of the sheet bending means 6 for the sake of convenience.

Figure 4:
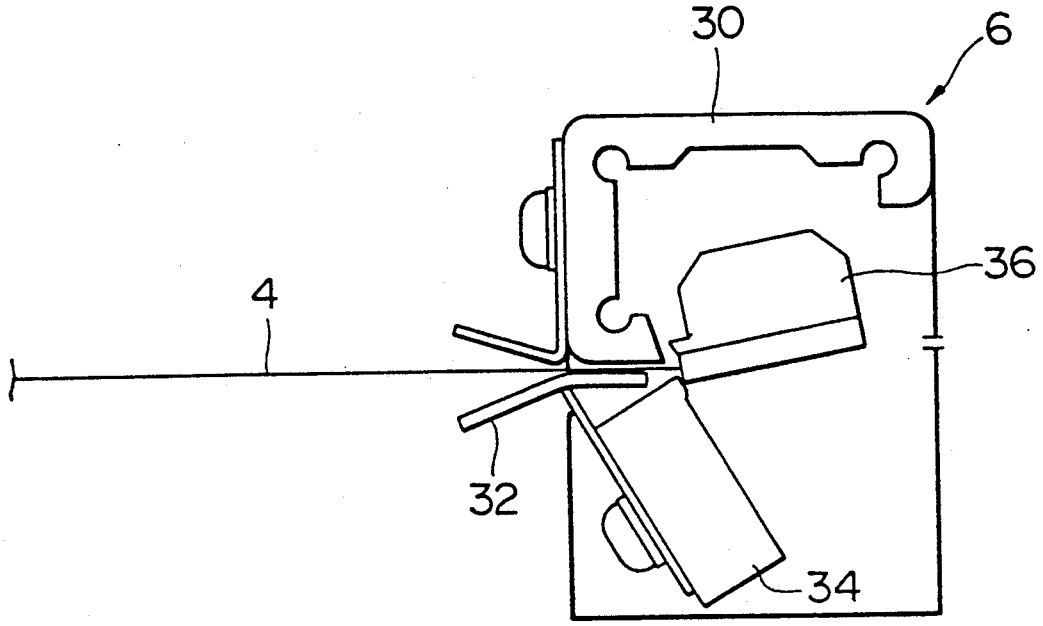
FIG. 4 is a schematic view of means for bending the leading ends of copy sheets according to one embodiment of the invention.
Figure 5:
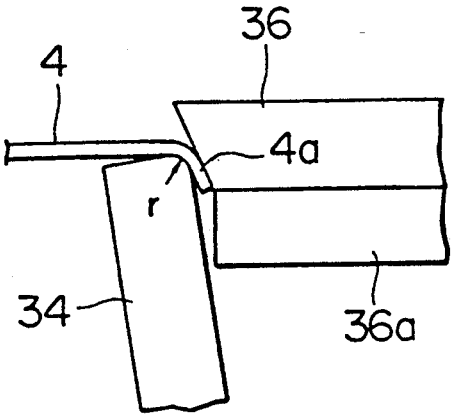
FIG. 5, is a schematic enlarged view of a portion of the sheet bending means shown in FIG. 4.

FIGS. 4 and 5 illustrate one embodiment of means 6 for bending the leading ends of the copy sheets in the direction toward the photoreceptor drum 12. As shown in FIG. 4, each copy sheet 4 is delivered to a guide 32 provided on a stay 30 of the sheet bending means 6. A stationary blade 34 is fixed to the stay 30 or to side plates of the sheet bending means 6. The edge of the stationary blade 34 has a configuration different from that of a conventional cutter, and it has a rounded edge having a radius r, as shown in FIG. 5. A bending blade 36 for bending the leading end 4*a* of the copy sheet 4 is rotatably provided on the side plates. The copy sheet 4 is fed between the stationary blade 34 and the bending blade 36, and stopped by a lower blade portion 36*a* of the bending blade 36. Then, the bending blade 36 is moved downwardly to thereby bend the leading end 4*a* of the copy sheet 4.

Figure 6A:
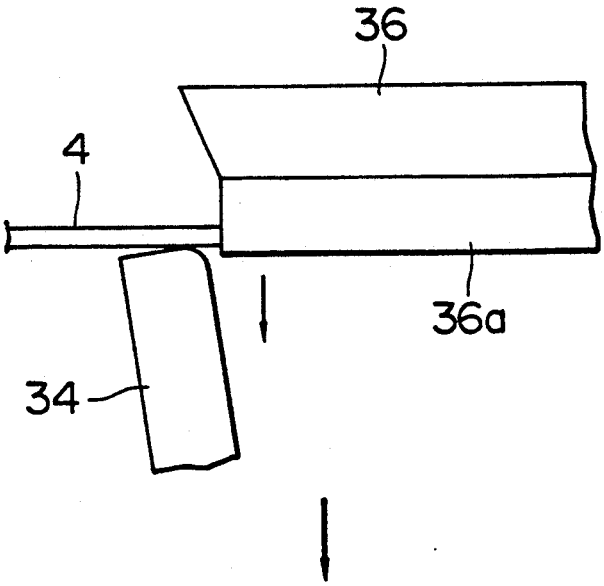
FIGS. 6A, 6B and 6C are schematic enlarged views showing the process of bending the leading end of a copy sheet in this embodiment.
Figure 6B:
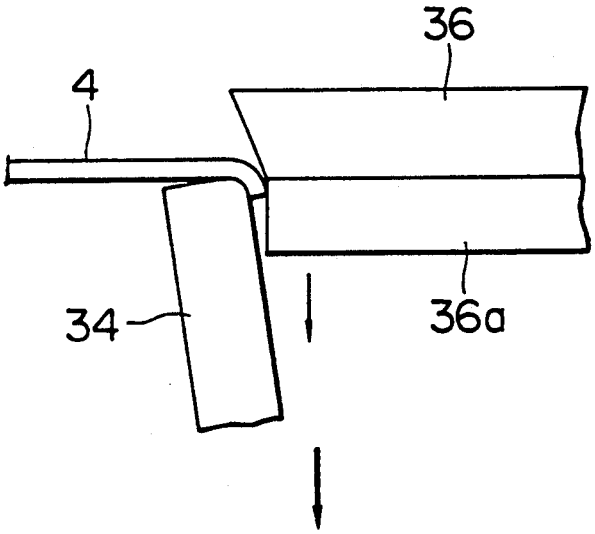
Figure 6C:
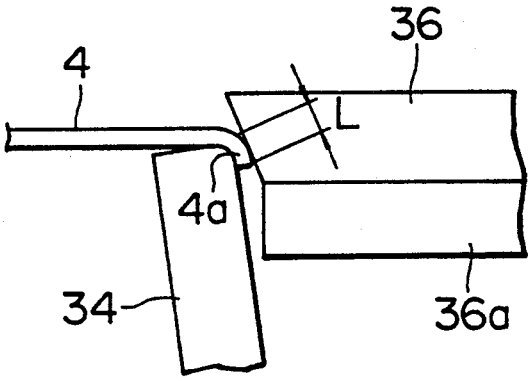

FIGS. 6A, 6B and 6C illustrate the process of bending of the leading end 4*a* of the copy sheet 4.

The copy sheet 4 is delivered until the leading end 4*a* of the copy sheet 4 abuts against the lower blade portion 36*a* of the bending blade 36, and the copy sheet 4 is stopped. After that, when the bending blade 36 is moved downwardly, the leading end 4*a* of the copy sheet 4 is fed between the stationary blade 34 and the bending blade 36, and it is bent over a bending length of L. The bending blade 36 is reciprocatingly translated or fully rotated around an axis.

Figure 7:
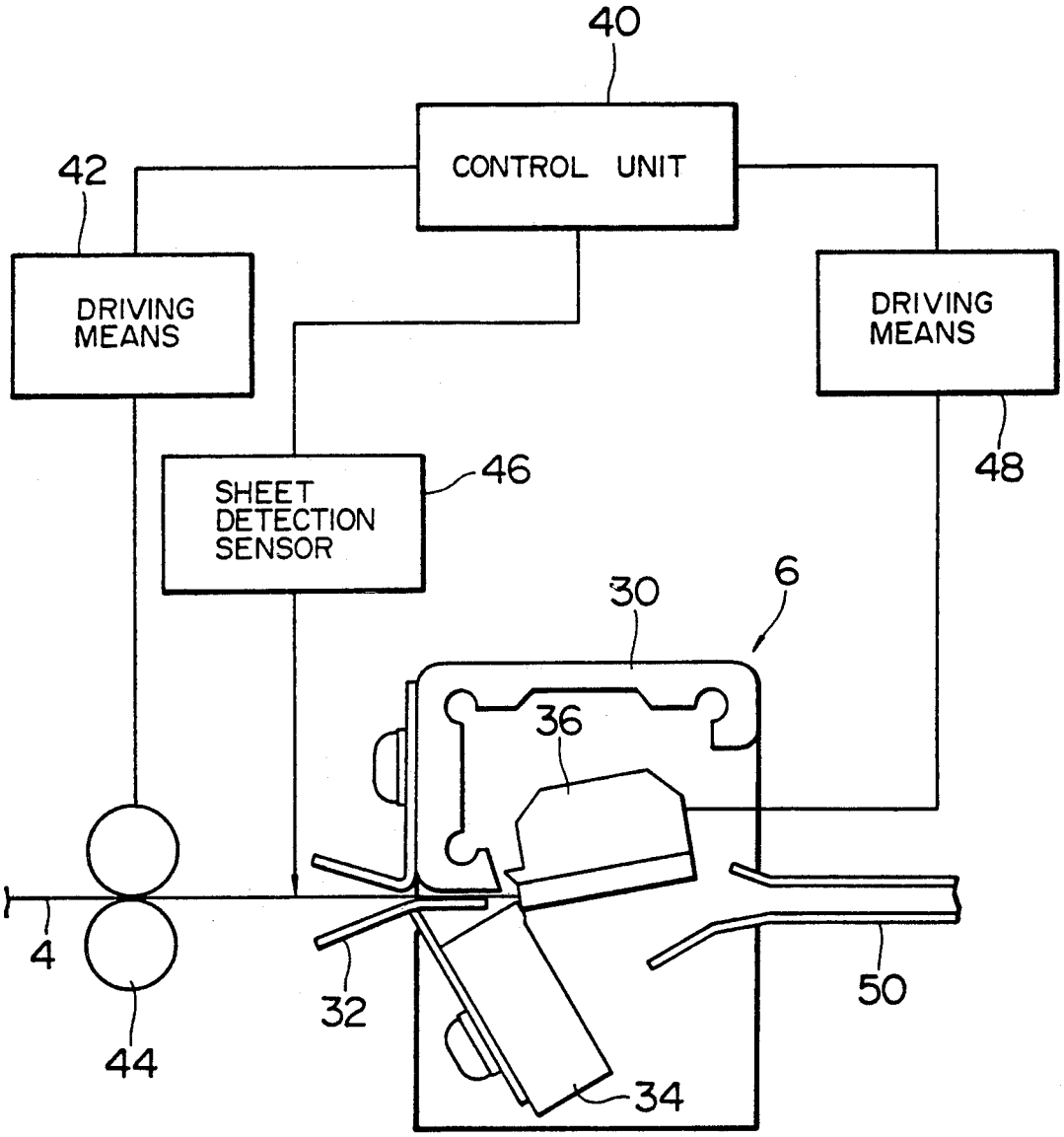
FIG. 7 is a schematic view of a control for the sheet bending means according to the present invention.

As shown in FIG. 7, delivery of the copy sheet 4 is conducted when feeder rollers 44 are driven by feeder roller driving means 42 which are controlled by a control unit 40. The leading end of the copy sheet 4 is detected by a sheet detection sensor 46 which is located immediately before the sheet bending means 6. The control unit 40 judges this detection signal and sends a driving signal to bending blade driving means 48 to thereby drive the bending blade 36. After a certain period of time, the control unit 40 functions so that the bending blade 36 is further driven and then retracted, and the copy sheet 4 is delivered to a delivery passage 50 at the downstream side. After the copy sheet 4 has been passed through the sheet bending means 6, the bending blade 36 is controlled to stop at such a position that the leading end of the next copy sheet 4 will be stopped by the lower blade portion again.

Figure 8:
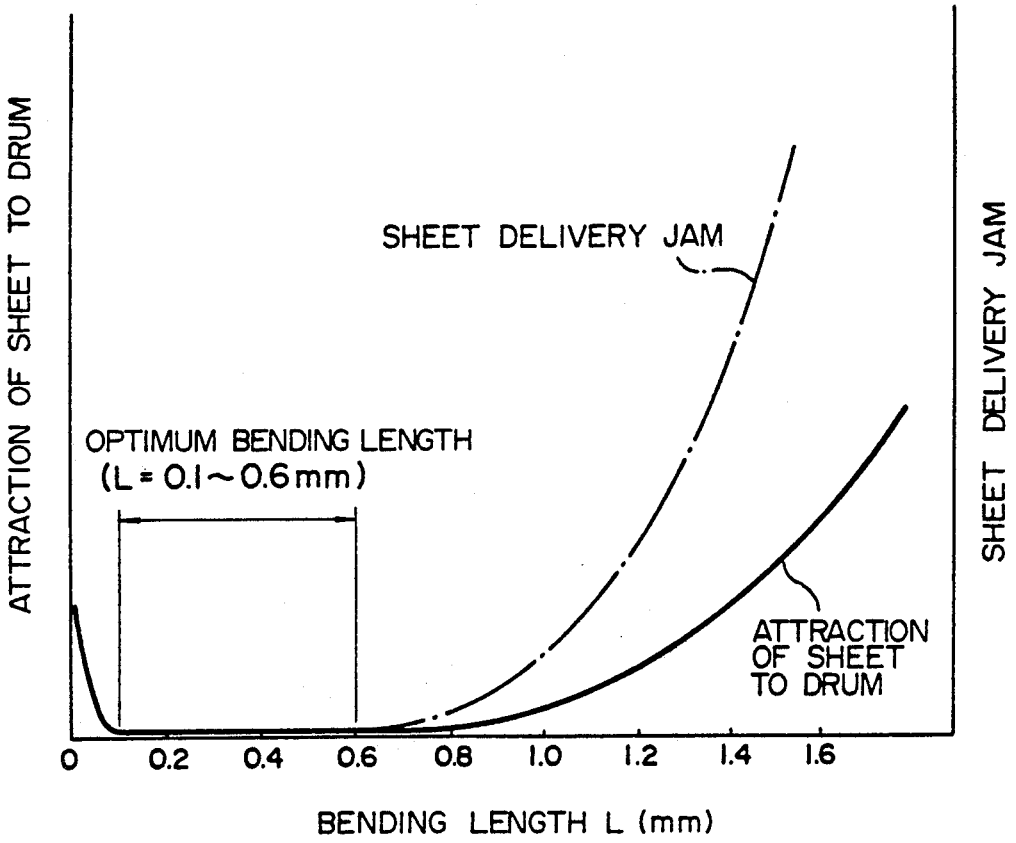
FIG. 8 is a graphical illustration of a relationship between a bending length L of the copy sheet leading end and attraction of the copy sheet to the photoreceptor and a copy sheet delivery jam.

As shown in FIG. 8, an appropriate bending length L (FIG. 6C) provided by the sheet bending means 6 is 0.1 to 0.6 mm. When the bending length L is not more than 0.1 mm, the bending effect is so inadequate that the copy sheet 4 will be attracted to the photoreceptor drum 12. On the other hand, when the bending length L exceeds 0.6 mm, problems are often caused in the sheet delivery passage and a stacker.

According to the invention, the means for bending the copy sheet toward the photoreceptor drum by a length of 0.1 to 0.6 mm is, constructed so as not to produce any effect to a sheet having such a thickness that it will not be attracted to the photoreceptor drum. Besides, the leading end of the copy sheet is stopped by the stopper once, and the double-edge blade for bending the leading end by a length of 0.1 to 0.6 mm is operated to work on the leading end of the copy sheet as it is. Therefore, there will be no operational errors such as bending the leading end of the copy sheet by more than a predetermined length.

Figure 9:
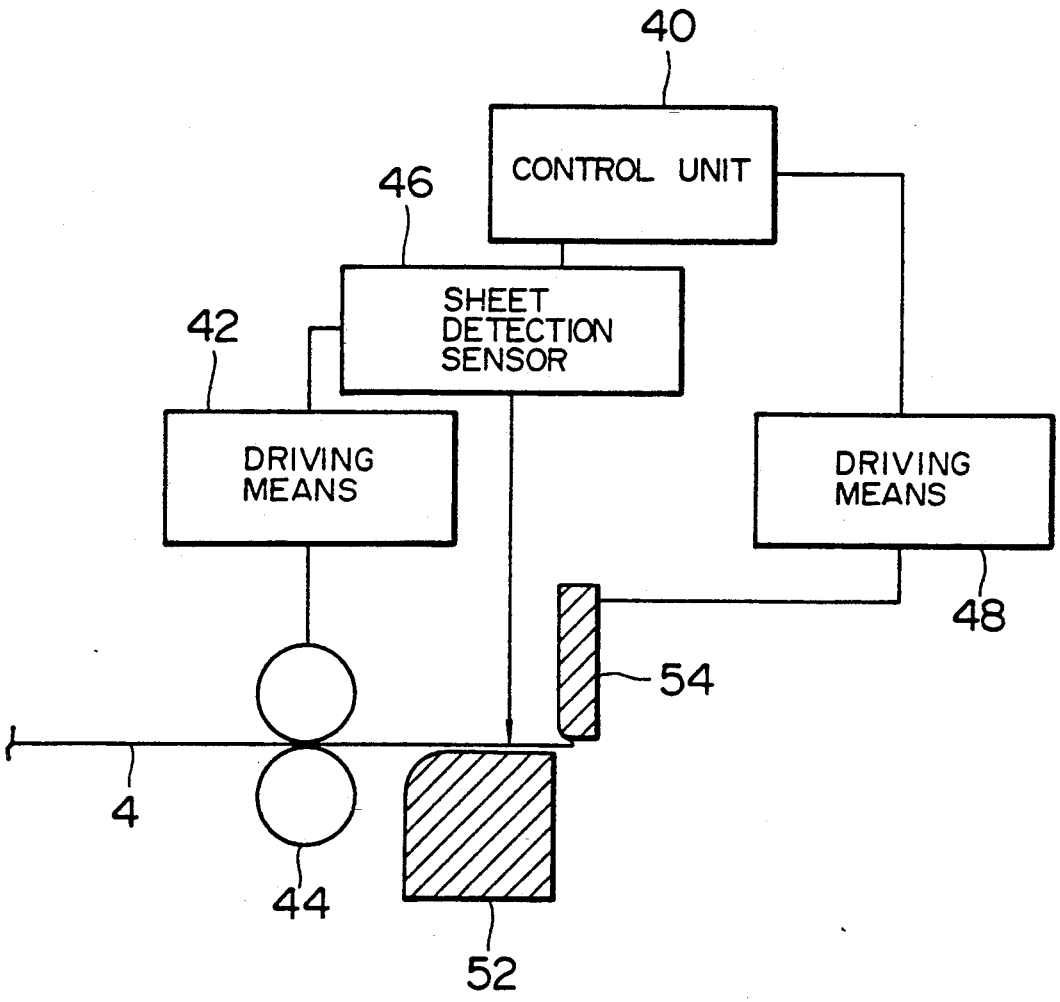
FIG. 9 is a schematic view or a control for means for bending the leading ends of copy sheets according to another embodiment of the invention.
Figure 10A:
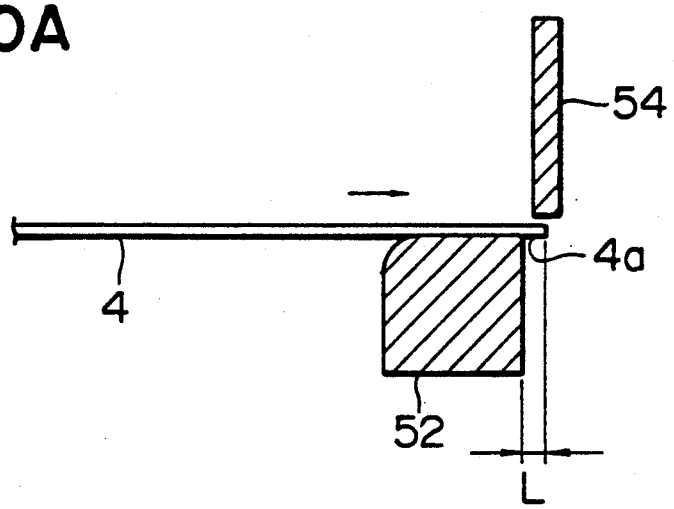
FIGS. 10A, 10B and 10C are schematic cross-sectional views of a process of bending the leading end of a copy sheet in the embodiment shown in FIG. 9.
Figure 10B:
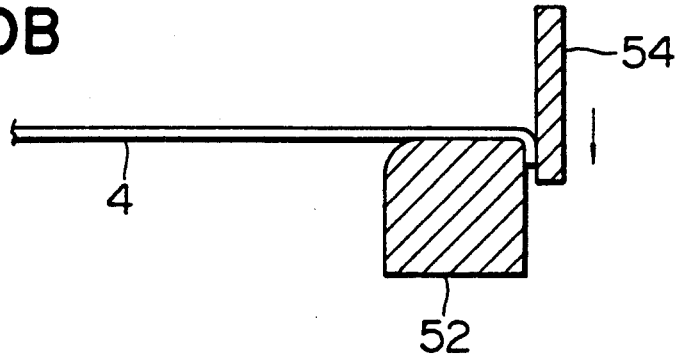
Figure 10C:
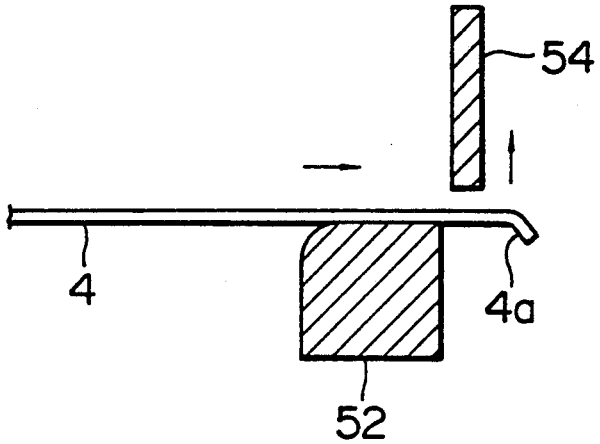

In the embodiment of FIG. 9, each copy sheet 4 is delivered by the feeder rollers 44, and the leading end 4a of the copy sheet 4 is detected by the sheet detection sensor 46. When the leading end 4a of the copy sheet 4 is projected over the bending length L, from the end face of a stationary member 2, a reciprocating blade 54 works on it from above to bend a portion of the copy sheet 4 of the bending length L from the end face of the stationary member 52, and then, the reciprocating blade 54 which is retracted upwardly. This embodiment can produce substantially the same effect as the embodiment shown in FIG. 4.

Figure 11:
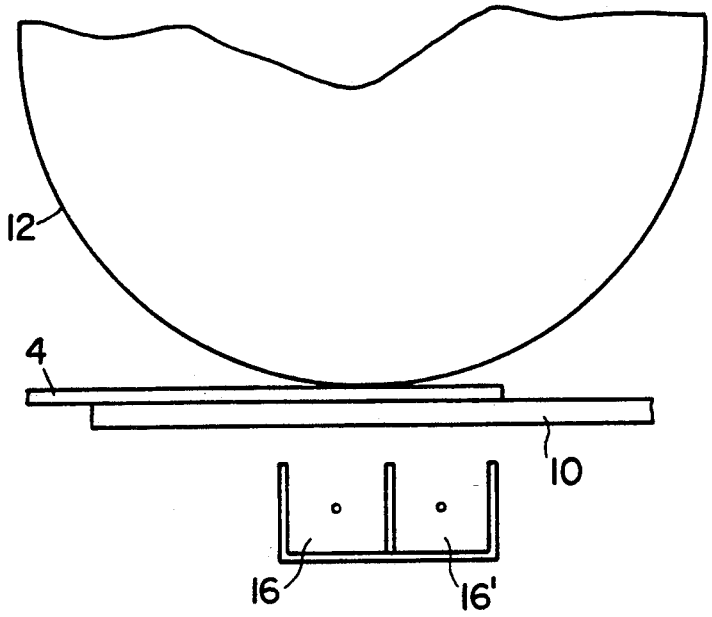
FIG. 11 is a schematic view of a transfer section of a further embodiment of the present invention.
Figure 12:
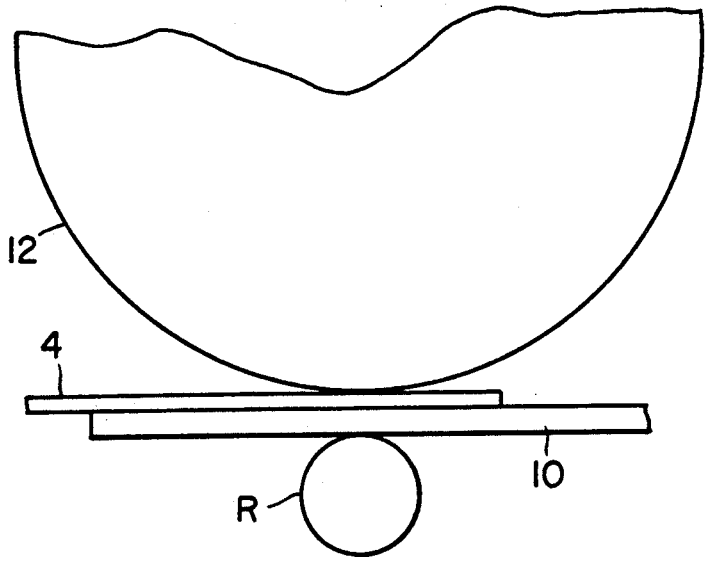
FIG. 12 is a schematic view of a transfer section of yet another embodiment of the present invention.

In these embodiments, when a separation corrotron 16' is, as shown in FIG. 11, provided on the back side if the transfer belt 10 or when a copy sheet 4, as shown in FIG. 1, pressed against the photoreceptor by rubber rollers R having high electric resistance, or a bias voltage is applied to such rubber rollers R, to thereby attract the toner, a clear image without defects can be obtained.

According to the present invention, there can be prevented the problem of attraction of copy sheets to the photoreceptor drum which is induced by sags, curls or the like of end portions of copy sheets which are caused when the sheets are cut.

Moreover, the invention requires no additional means for separating copy sheets from the photoreceptor drum, thus resulting in a cost reduction effect.

What is claimed is :

1. In an electrophotographic apparatus comprising sheet supply means for separately individually supplying stacked copy sheets, an endless transfer belt of a dielectric material for delivering each of said copy sheets while electrostatically attracting the respective copy sheets, pulleys for driving said transfer belt, at least one pulley around which said transfer belt runs, a photoreceptor for carrying an electrostatic latent image corresponding to an image information and a toner electrostatically attracted to said electrostatic latent image, and a transfer section where each of said copy sheets is held between said photoreceptor and said transfer belt and is in contact with said photoreceptor and said transfer belt so as to transfer the toner image on said photoreceptor to the copy sheet delivered by said transfer belt, the improvement comprising means provided between said sheet supply means and said transfer section for bending the leading end of each of said copy sheets slightly in a direction toward said photoreceptor, and wherein the leading end of said copy sheet is bent by a length of 0.1 to 0.6 mm.

2. In an electrophotographic apparatus comprising sheet supply means for separately individually supplying stacked copy sheets, an endless transfer belt made of a dielectric material for delivering each of said copy sheets while electrostatically attracting the sheet, pulleys for driving said transfer belt, at least one pulley around which said transfer belt runs, a photoreceptor for carrying an electrostatic latent image corresponding to an image information and a toner electrostatically attracted to said electrostatic latent image, and a transfer section where each of said copy sheets is held between said photoreceptor and said transfer belt and is in contact with said photoreceptor and said transfer belt so as to transfer the toner image on said photoreceptor to the copy sheet delivered by aid transfer belt, the improvement comprising means provided between said sheet supply means and said transfer section for bending leading ends of said copy sheets, said sheet bending means comprising a support section for supporting the leading end of each of said copy sheets, a stationary section having a round edge adapted to contact the leading end of said copy sheet, and a movable section adapted to be moved with a predetermined gap from said stationary section so that the leading end of aid copy sheet, located in the gap between said stationary section and said movable section is bent slightly in a direction toward said photoreceptor, and wherein said gap between said stationary section and said movable section is such that the leading end of said copy sheet is bent by a length of 0.1 to 0.6 mm.

3. An electrophotographic apparatus according to claim 2, wherein said movable section includes an abutment adapted to be contracted with the leading end of a delivered copy sheet so as to stop the delivered copy sheets.

4. An electrophotographic copying apparatus according to claim 2, wherein said movable section is rotatable.

5. An electrophotographic copying apparatus according to claim 2, wherein said movable section is adapted to be translated linearly and reciprocatingly.

6. An electrophotographic apparatus according to any one of claims 1 or 2, further comprising a transfer corrotron disposed on a backside of aid transfer belt.

7. An electrophotographic apparatus according to any one of claims 1 or 2, further comprising a transfer corrotron and a separation corrotron disposed on a backside of said transfer belt.

8. An electrophotographic apparatus according to any one of claims 1 or 4, wherein said transfer section comprises rubber rollers of high electric resistance for pressing said copy sheet against said photoreceptor so as to transfer a toner image on said photoreceptor to said copy sheet.

9. An electrophotographic apparatus according to any one of claims 1 or 2, wherein said transfer section comprises rubber rollers of high electric resistance for pressing said copy sheet against said photoreceptor so as to transfer a toner image on said photoreceptor to said copy sheet to which rollers as bias voltage is applied.

10. A method or preventing a copy sheet from being attracted to a photoreceptor in an electrophotographic apparatus, the method comprising the steps of:

individually and separately supplying stacked copy sheets, electrostatically attracting each of said copy sheets to and delivering each of said copy sheets by an endless transfer belt made of a dielectric material until said copy sheet reaches a transfer section where said copy sheet is held between the photoreceptor and said transfer belt and is in contact with the photoreceptor and the transfer belt, said photoreceptor carrying an electrostatic latent image corresponding to an image information and a toner electrostatically attracted to said electrostatic latent image, transferring the toner image on said photoreceptor to the copy sheet delivered by said transfer belt, and slightly bending the leading end of each of said copy sheets delivered to said transfer section in a direction toward said photoreceptor, and wherein the leading end of said copy sheet is bent over a length of 0.1 to 0.6 mm.

* * * * *